United States Patent [19]

Crosby

[11] Patent Number: 4,586,700

[45] Date of Patent: May 6, 1986

[54] MODULAR SEAT SPRING ASSEMBLY

[75] Inventor: Lawton H. Crosby, Lake Bluff, Ill.

[73] Assignee: Morley Furniture Spring Corporation, Lake Bluff, Ill.

[21] Appl. No.: 446,314

[22] Filed: Dec. 2, 1982

Related U.S. Application Data

[63] Continuation-in-part of Ser. No. 228,583, Jan. 26, 1981, abandoned, which is a continuation-in-part of Ser. No. 83,347, Oct. 10, 1979, abandoned.

[51] Int. Cl.[4] ..... A47C 7/28; F16F 3/02

[52] U.S. Cl. ..... 267/105; 5/247; 5/255; 5/260; 267/109; 267/110

[58] Field of Search ..... 267/87, 102, 103, 104, 267/105, 106, 107, 108, 109, 110, 111, 112, 144, 165; 5/247, 255, 260, 261; 297/452, 456

[56] References Cited

U.S. PATENT DOCUMENTS

| | | | |
|---|---|---|---|
| 2,250,486 | 7/1941 | Kronheim | 267/108 |
| 2,257,633 | 9/1941 | Bank | 267/110 |
| 2,366,607 | 1/1945 | Freeman | 267/103 |
| 2,835,315 | 5/1958 | Neely | 267/107 |
| 2,958,375 | 11/1960 | Bond | 267/112 |
| 3,098,646 | 7/1963 | Knabusch et al. | 267/112 |
| 3,210,064 | 10/1965 | Crosby | 267/103 |
| 3,239,208 | 3/1966 | Klicki | 267/105 |
| 3,525,514 | 8/1970 | Crosby et al. | 267/110 |
| 4,029,303 | 6/1977 | Quakenbush | 267/110 |
| 4,247,089 | 1/1981 | Crosby et al. | 267/110 |

FOREIGN PATENT DOCUMENTS

| | | | |
|---|---|---|---|
| 2745256 | 5/1978 | Fed. Rep. of Germany | 267/110 |

*Primary Examiner*—Bruce H. Stoner, Jr.
*Assistant Examiner*—Richard R. Diefendorf
*Attorney, Agent, or Firm*—Willian Brinks Olds Hofer Gilson & Lione

[57] ABSTRACT

A furniture seat base which employs a series of front and/or back torsioned sinuous spring bands. Predetermined patterns of torsioned bands produce an interaction which generate spring dynamics designed to produce a seat unit which may be sat upon from the front, back, sides, or corners with excellent comfort characteristics. The bands are selectively supported adjacent the rails to obviate objectionable "lean-out."

7 Claims, 7 Drawing Figures

MODULAR SEAT SPRING ASSEMBLY

RELATED APPLICATION

This application is a continuation-in-part of application Ser. No. 228,583, filed Jan. 26, 1981, which is, in turn, a continuation-in-part of application Ser. No. 83,347, filed Oct. 10, 1979, both of which are now abandoned.

FIELD OF THE INVENTION

This invention relates in general to furniture seat base assemblies. It relates particularly to furniture seat base assemblies for omnidirectional seat units and the like.

BACKGROUND OF THE INVENTION

Modular seat units of furniture, commonly called "pit groups" in the trade, have, solely because of style, convenience, and utility, become a major factor in furniture sales during the past five years. In fact, in some markets, the volume of modular furniture sales exceeds that of traditional sofas, love seats, and lounge chairs.

Manufacturers of modular seat units have, with the aid of skilled designers, achieved outstanding style renditions. This achievement figures prominently in the sales of these pit groups. It is said in the trade that all pit groups look comfortable. It is also known in the trade, however, that no pit groups presently manufactured feel truly comfortable.

This is because severe difficulties are encountered in modular furniture seat base construction, imposed primarily by the inherent nature of a pit group. One factor is that their styling normally calls for them to be at somewhat lower sitting height than traditional sofas, love seats, or lounge chairs. The second problem, until now virtually unsolvable, is caused by the fact that among the modular units are both one-arm and no-arm sofas, love seats, and chairs, and even bumper-units with no arms or backs.

These modular units of the group can be, and normally are, arranged in many configurations: semirectangles, semicircular, horseshoe-shaped, inner and outer triangles, and so on, limited only by the imagination of the owner. It is apparent that in many arrangements sitters will sit facing not only forward in the normal way, but also 90° to either the left or right side, to the rear, or even diagonally; i.e., "omnidirectionally". Thus, pit groups require equal sitting comfort and support in all of five sitting directions.

Obviously, this means that the configurations of normal spring seat bases simply will not work, as they are all normally designed to give downward deflection to a marked degree at the back rail, and virtually no deflection, or a very little, at the front rail. Thus, if a person were to sit facing sideways on a chair, for example, with a normal spring base he would lean most uncomfortably toward either his left side or his right side, depending upon where the seat back would normally be.

The problem is magnified even more in modulars by the fact that women often sit in them curled up sideways with both legs tucked up under them. The need in modular seating is three-fold: first, to improve the present gross-substandard level of sitting comfort in general; second, to provide acceptable sitting comfort omnidirectionally, regardless of the direction in which the sitter is sitting; third, to provide this omni-directional seating without objectionable "lean-out" regardless of the direction of sitting.

No present seat base constructions used in pit groups meet these needs. Further, no normal seat base constructions giving desired comfort levels in deflection, resilience, and support as used in regular upholstered living room furniture, can be installed in pit groups under the operational constraints and performance requirements noted.

To sum up, pit groups call for a seat base which gives substantially uniform sitting comfort and support circumferentially, regardless of the direction in which the sitter is facing, and without "lean-out" in any direction.

All modular furniture presently uses either a polywebbing pulled tight, de-arced flat sinuous spring bands pulled tight, a wire grid or mesh pulled tight, or in some cases even a flat piece of plywood under the cushion. Regardless of which of these is used, however, the net result is the same: an uncomfortable, relatively unyielding seat that would never be accepted in traditional love seats, sofas, or living room lounge chairs.

This is obviously not in the best interest of either the manufacturers or the purchasing public. However, because of the necessity to provide for omnidirectional seating manufacturers have had to deliberately sacrifice normal standards of comfort.

In order to give some small degree of initial softness, therefore, manufacturers have been forced to go to the expense of using unusually thick cushioning materials, or premium costly materials. In fact, however, this does not solve the problem, or even alleviate it to any substantial degree, because a person still sinks through the cushion and winds up on the uncomfortably hard, virtually unyielding, flat underbase.

SUMMARY OF THE INVENTION

An object of the present invention is to provide a new and improved seat base assembly. It is another object to provide a seatbase assembly for furniture units which generates substantially uniform spring dynamics regardless of where or in what direction a person is seated on the furniture seat base. It is a further object to provide a new and improved seatbase assembly for modular seat units which overcomes all of the aforedescribed shortcomings of modular furniture seats. Still another object is to provide a modular furniture seat base assembly which achieves a seating comfort normally heretofore associated only with traditional upholstered furniture.

Specifically, the objective is first to provide a spring seat base that gives a high level of comfort in deflection and resilience characteristics regardless of the direction which the sitter faces and, second, to provide that such a spring seat base does not have undesirable "lean-out" in any direction of sitting.

The foregoing and other objectives are realized by a novel furniture seat base construction which employs normally-arced sinuous spring bands of a specific form mounted in a new and unique manner according to the invention. Each band incorporates a self-contained torsioning component which, by itself, is substantially identical to those illustrated in U.S. Pat. No. 3,388,904, assigned to the same assignee as the present invention.

One aspect of the present invention is embodied in transversely alternating, individual front and back torsioned springs. The resulting interaction of these bands in a seat spring assembly generates unexpected spring dynamics arising from the combination of opposing moment-arms, yield-points, deflection and resilience characteristics. Another aspect is the use and relationship of precisely positioned cross-ties extending transversely of the bands. Yet another aspect is the use of span and key supports for the assembly under the outermost bands.

The net result is dramatically improved seating in a seat unit which may be sat upon from the front, back, sides, or corners, if a person chooses to do so. Uniform comfort characteristics are achieved without "lean-out".

The unexpected results of this end-alternating, leverage-amplification is that the sitter, for the first time in modulars, gets all the desired features of first-class stationary furniture; downward softness without loss of upward-resilience, correct support, and absence of lean-out. Most important, the sitter gets all of these features regardless of the direction of sitting. An important additional feature of this invention is that for the first time in any sinuous springbase there is substantially unitized deflection and unitized resilience or uplift throughout the construction. Both at the front and the back the entire spring base moves and yields as a unit, or a deck, from front to back, and from side to side.

The net result of these spring dynamics is spectacular in comparison with any current spring base or other base now manufactured and sold in modulars. There is no comparison in softness, initial-drop, uplift, or bouyancy, and in overall sitting comfort.

Further, and of great importance to manufacturers of modulars, is the fact that with the spring base of this invention there is, for the first time, a true spring action. Significant costs can thus be saved in the thickness and type of polyfoam used in the cushioning.

A first form of seat base assembly embodying features of the invention employs six (6)sinuous bands. According to the invention, spring bands No. 1 and 6 are installed with their torsioning component adjacent the back rail. Springs No. 2 and 5 are installed with their torsioning components torsioning adjacent the front rail. Springs No. 3 and 4 incorporate torsioning adjacent the back rail.

Two cross ties or, as they are sometimes called, stay-braces, are clamped transversely across these sinuous spring bands evenly spaced between the front and back rails, unitizing them into a functional whole. In this form of the invention, because of the configuration and arrangement of bands No. 1 and 6, span and key vertical band supports are also utilized under bands No. 1 and 6.

A second form of the present invention also employs six (6) sinuous bands. It is similar to the first form except that the spring bands are reversed. As a result, the self-contained torsioning component in bands No. 1 and 6 is adjacent the front rail instead of the back rail.

Cross ties are again employed in the manner hereinbefore discussed. In this form of the invention, however, span and key vertical band supports are not utilized because stiffness adjacent the back rail in the spring bands provides requisite rail support.

A third form of the invention employs four (4) bands. Bands No. 1 and 4 have their torsioning components adjacent the back rail while bands No. 2 and 3 have it adjacent the front rail. Cross-ties and span and key arrangements are both employed.

Other forms of the invention employ an odd number of sinuous spring bands. A fourth form employs five (5) or seven (7) bands. In a five (5) band pattern bands No. 1, 3, and 5 preferably have self-contained torsioning components adjacent the back rail. Bands No. 2 and 4 have torsioning components adjacent the front rail. This pattern is followed in a seven (7) band pattern. Cross-ties and span and key arrangements are also employed in this form of the invention.

A fifth form also employs five (5) bands, seven (7) bands, or a larger odd number of bands. In this however, the bands are reversed. Cross-ties are employed but span and key members are not. This pattern is also followed in larger odd number band patterns.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENTS

Figure 1:
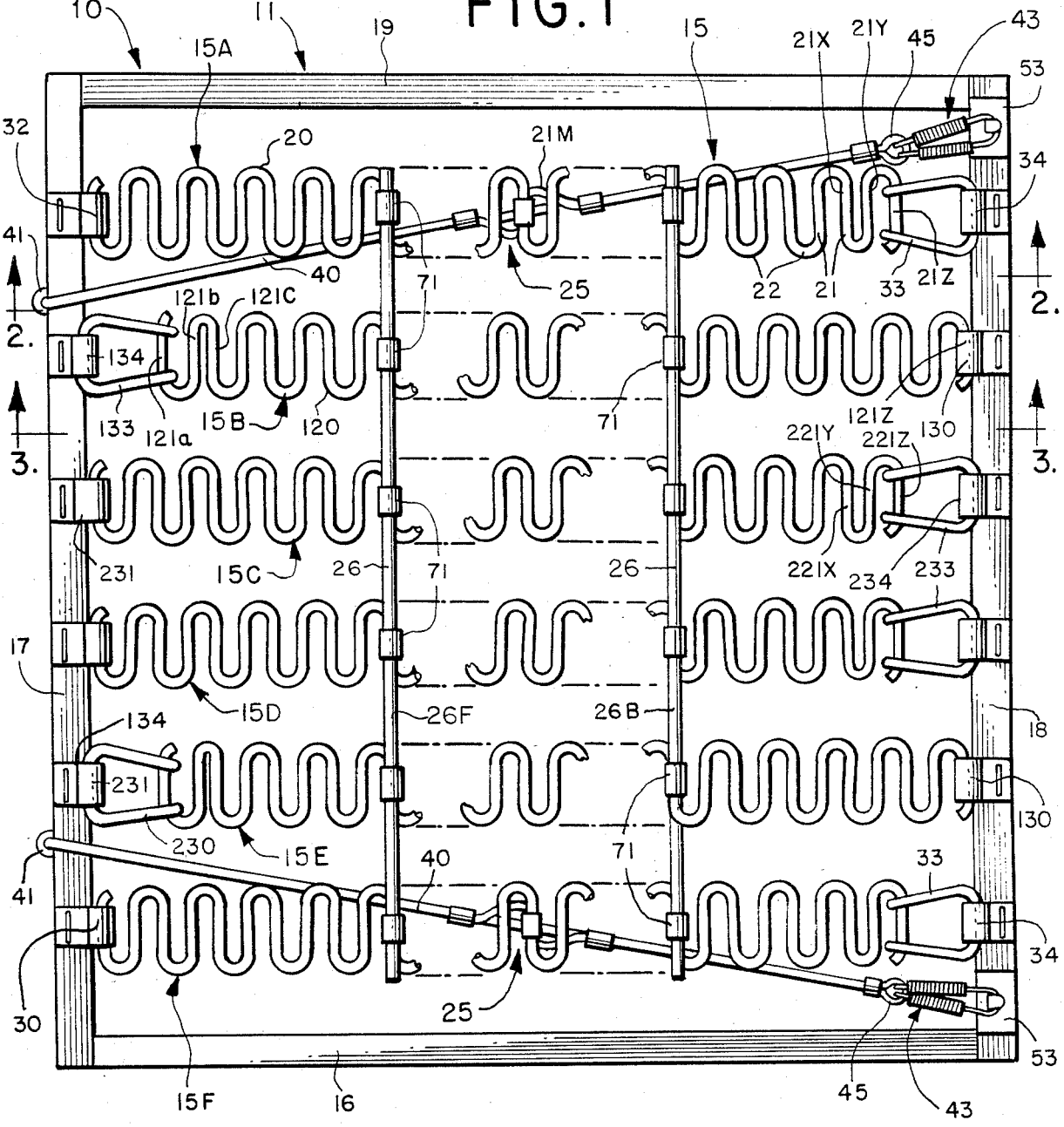
FIG. 1 is a plan view of a modular furniture unit seat base assembly embodying features of a first form of the present invention.

Referring now to the drawings, and particularly to FIG. 1, a seat base assembly for a modular furniture unit seat base and embodying a first form of the present invention is seen generally at 10. The seat base has a square, ottomanlike configuration with uniform side dimensions. The seat base assembly 10 includes a seat frame 11 and a plurality of sinuous band assemblies 15 mounted in it and interconnected according to the invention.

The seat frame 11 includes a front rail 17, a back rail 18, and side rails 19 and 16. All are fabricated of hard wood in a conventional manner. The sinuous band assemblies 15 extend parallel to the side rails 19 and 16 between the front and back rails 17 and 18. The unit 10 will be seen to incorporate six (6) such sinuous band assemblies 15A through 15F. The first and sixth band assemblies 15A and 15F are supported by span-key assemblies 25 in a manner which will be hereinafter discussed. All of the sinuous band assemblies 15 are interconnected by cross ties 26 in a manner hereinafter discussed.

Figure 2:
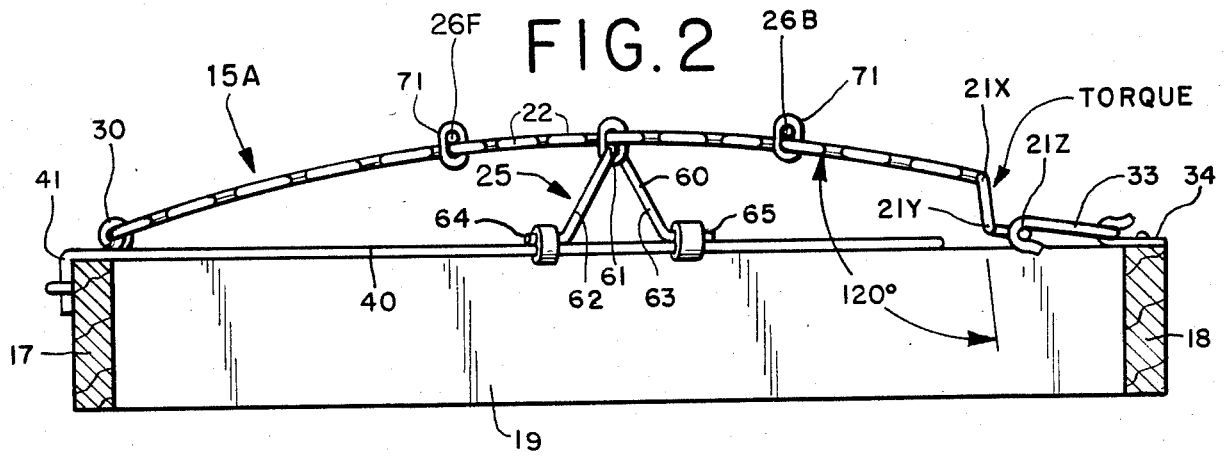
FIG. 2 is a sectional view taken along line 2—2 of FIG. 1.

Referring now to FIG. 2, the sinuous band assembly 15A is illustrated. The band assembly 15A is one of the two outermost band assemblies, this one being closest to the side rail 19. It is one of the two sinuous band assemblies 15 which is provided support from a span-key support assembly 25 in this first form of the invention.

The sinuous band assembly 15A comprises a normally arced sinuous band 20. The band 20 includes a plurality of generally parallel linear wire segments 21 interconnected by generally semicircular wire segments 22. The normal or relaxed configuration of the band 20 is a portion of a circle which, in use, is stretched out to the profile illustrated in FIG. 2.

Each sinuous spring band 20 is pivotally mounted on the front rail 17 in a conventional clip 30. The forward-most linear segment 21*a* of the sinuous spring band 20 seats in the clip 30 a well-known manner.

The spring band 20 is pivotally connected to the back rail 18 in a manner considerably more sophisticated than that at the front rail. Furthermore, the configuration of the back end of the band 20 is modified to introduce torque at the back end of the band in a manner described in the aforementioned U.S. Pat. No. 3,388,904, assigned to the same assignee as the present invention.

Specifically, the spring band 20 is bent downwardly at the third linear segment 21*x* from the back end of the band to form, with the body of the band, an interior angle of approximately 120° with the band in place. The band 20 is then bent horizontally outwardly again at the second liner segment 21*y* from its back end so that ultimate linear segment 21*z* is positioned as illustrated in FIG. 2. This ultimate linear segment 21*z* is then connected to the back rail 18 by a swing anchor 33 and another conventional clip 34, the swing anchor 33 being similar to that illustrated in U.S. Pat. No. 3,790,149, also assigned to the same assignee as the present invention.

The band assembly 15A is supported by a span-key assembly 25, as seen in FIGS. 1 and 2. The assembly 25 includes a stiff wire member 40 which spans the seat frame between the front rail 17 and the back rail 18 under the band assembly 15A and is fastened to these rails at opposite ends. The wire span member 40 comprises conventional, paper covered wire which is formed downwardly at its front end, as at 41, and fastened with the aid of staples to the front surface of the front rail 17. The member 40 is fastened to the back rail 18 through a heavy-load helical spring connector assembly 43.

The span 40 is bent back upon itself at its back end and clamped to form a wire loop 45. The connector assembly 43 includes a pair of high spring resistance helicals having only six or seven turns hooked into the loop 45 at corresponding one ends. At their opposite ends the helicals are connected to the rail 18 by a conventional attachment clip 53 stapled to the top of the rail.

It will be seen that the front end 41 of the wire span member 40 is fastened to the rail on one side of the sinuous spring band 20 while the back end 45 is fastened to the back rail 18 on the other side of the band. The effect is to cause the wire member 40 to pass diagonally under the sinuous spring band 20.

In fastening the back end 45 to the back rail 18 the helical springs are stretched, normally with an attachment tool, and then seated in the clip 53. As a result, the span 40 is stretched between the rails by a resilient but substantial force.

Mounted on the wire span member 40 approximately intermediate its ends, and fastened to the sinuous spring band 20 approximately intermediate its ends, is a "key" member 60 formed also of paper-covered wire. The key member 60 is bent irregularly in the shape illustrated in FIG. 2 so as to have, when mounted in the position illustrated, a horizontal mid-segment 61 corresponding in length to the transverse or width dimension of the sinuous spring band 20, downwardly and inwardly inclined side segments 62 and 63, and horizontally disposed end segments 64 and 65 in line with each other and extending parallel to the wire span member 40.

The mid-segment 61 is fastened to one of the parallel wire segments 21, the segment 21*m* in the present illustration, by a conventional sleeve clamp. The end segment 64 is, in turn, fastened securely to the wire span member 40 by a similar sleeve clamp, while the end segment 65 is fastened to the wire span member 40 by another sleeve clamp. At the points intermediate the span member 40 ends, where the end segments 64 and 65 are fastened, the span member is approximately centered under the band 20 in its diagonal path from side to side of the band.

Figure 3:
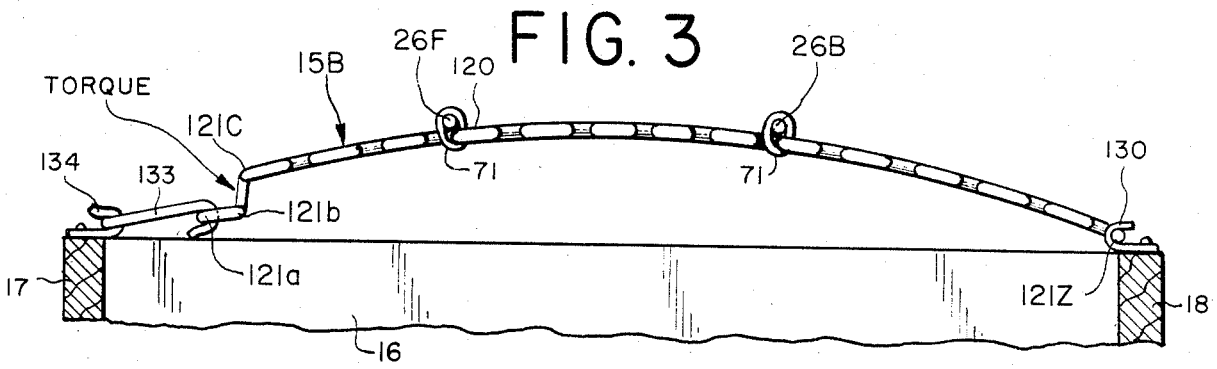
FIG. 3 is a sectional view taken along line 3—3 of FIG. 1.

Referring now to FIG. 3, the sinuous spring band assembly 15B is illustrated. It comprises a normally arced sinuous band 120 which includes a plurality of generally parallel linear wire segments interconnected by generally semicircular wire segments. Like the aforedescribed band 20, the normal or relaxed configuration of the band 120 is a portion of a circle which, in use, is stretched out to the profile illustrated in FIG. 3.

Each sinuous spring band 120 is pivotally mounted on the back rail 18 in a conventional clip 130. The rearward-most linear segment 121*z* of the sinuous spring band 120 seats in the clip 130 in a well-known manner.

The spring band 120 is pivotally connected to the front rail 17 in a manner considerably more sophisticated than at the back rail. The configuration of the front end of the band 120 is also modified to introduce torque at the front end in a manner discussed in the aforementioned U.S. Pat. No. 3,388,904.

The spring band 120 is bent downwardly at the third linear segment 121*c* from the front end of the band to form, with the body of the band, an interior angle of approximately 120° with the band in place. The band 120 is then bent horizontally outwardly again at the second linear segment 121*b* from its front end so that ultimate linear segment 121*a* is positioned as illustrated in FIG. 3. This ultimate linear segment 121*a* is then connected to the front rail 16 by swing anchor 133 and another conventional clip 134, the swing anchor 133 being identical to the anchor 33 hereinbefore discussed. Band assemblies 15F, 15E, and 15D are identical in construction and arrangement; i.e., they correspond to assemblies 15A, 15B, and 15C, respectively.

The band assemblies 15A–15F are tied together transversely by two cross-ties 26. Each is a stiff, paper-covered wire of length corresponding to the transverse dimension of the six (6) band assemblies together, in their mounted relationship.

As best seen in FIG. 1, cross-tie wire 26F (front) is clamped to each band 20, 120, etc. by corresponding sleeve clamps 71 one-third of the distance from the front rail 17 to the back rail 18. Cross-tie wire 26B (back) is, on the other hand, clamped to each band 20, 120, etc., by corresponding sleeve clamps 71 two-thirds of the distance from the front rail 17 to the back rail 18.

In operation, the seat base assembly 10 produces an extremely comfortable, omni-directional seat by a combination of (1) the effect of the carefully orchestrated torsion-produced resilience and uplift in each band assembly as related to the other band assemblies, (2) the transmission of each band assembly's action at two separate points transversely to bracketing band assemblies, and (3) the side rail stiffening produced by span and key assemblies to match and balance front and back rail stiffening inherent in front-to-back sprung sinuous seat spring assemblies. This combination in the seat spring assembly 10 produces a seat heretofore thought impossible in modular furniture.

Figure 4:
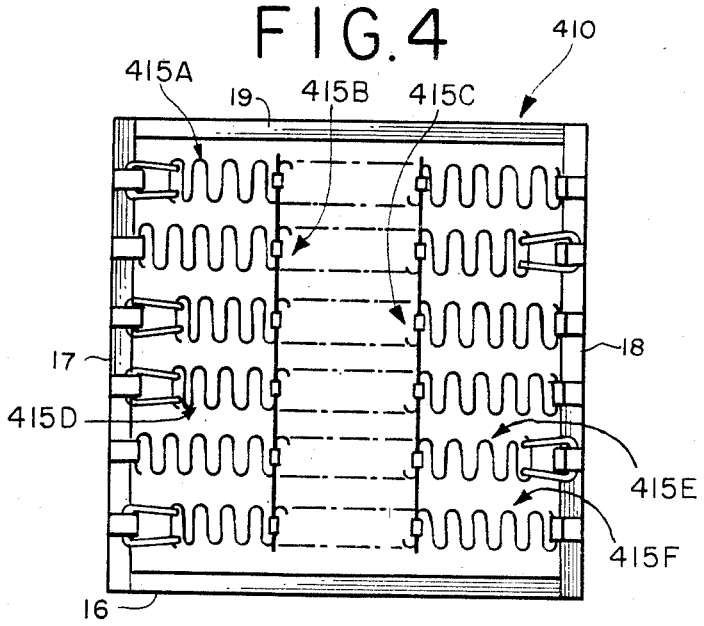
FIG. 4 is a view similar to FIG. 1 showing a seat base assembly embodying features of a second form of the present invention.

FIG. 4 illustrates a second form of seat base assembly 410 is embodying features of the invention. The seat base assembly 410 has, like the first form of the invention, six (6) sinuous bands, in this case identified as 415A–415F. The construction of the seat base assembly 410 identical to that of the seat base assembly 10 hereinbefore discussed except in one respect; i.e., its sinuous spring bands 415A, 415B, 415C, 415D, 415E, and 415F, are constructed identically to corresponding sinuous bands lOA, lOB, lOC, lOD, lOE, and lOF of the seat base assembly 10. However, they are mounted and arranged in reverse relationship to their correspondent bands.

Referring particularly to FIG. 4, it will be seen that this arrangement places the sinuous band 415A with its self-contained torsioning bends adjacent the front rail 17. The same is true of the sinuous band 415F.

As a result of this arrangement the span and key assemblies 25 and 325 employed in the first and second forms of the invention are eliminated. This is even a less expensive version of the six band seat spring assembly. It is possible because with no torsioning influence at the back ends of the outside bands 415A and 415F they are not as soft where a sitter's buttocks are normally positioned and thus can get by without the support of the span and key assembly. The saving is primarily one of cost, however, at the sacrifice of some luxury. A lower price line of furniture, still having far greater luxury in its seat than that heretofore known, is produced.

Figure 5:
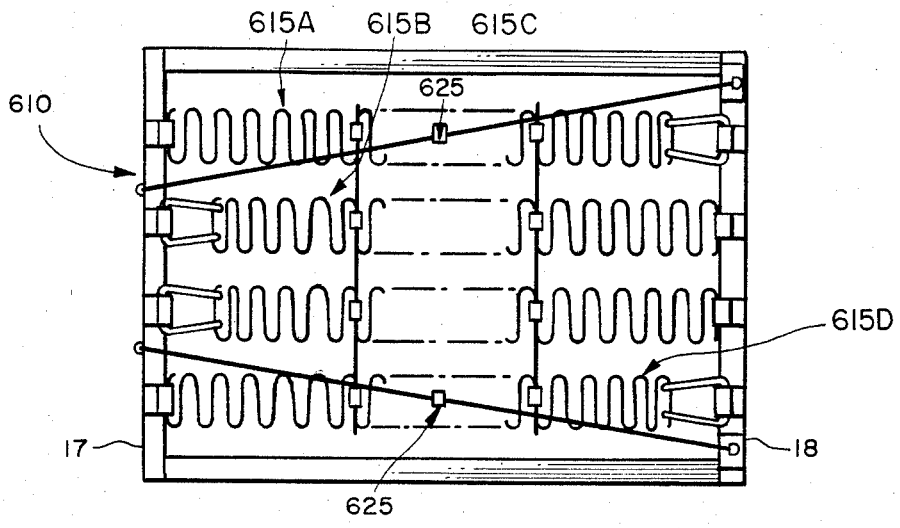
FIG. 5 is a view similar to FIG. 1 showing a seat base assembly embodying features of a third form of the present invention.

FIG. 5 illustrates a third form of seat base assembly embodying features of the present invention at 610. The assembly 610 employs four (4) sinuous spring bands 615A, 615B, 615C, and 615D. Each of these bands 615 employs a self-contained torsioning component only at one end; i.e., adjacent either the front rail 17 or the back rail 18, but not both.

The bands 615A, 615B, 615C and 615D in the seat base assembly 610 correspond to the bands 15A, 15B, 15D, and 15F in the seat spring assembly 310. Identical span-key assemblies 625 and cross-ties 626F and 626B are utilized.

Figure 6:
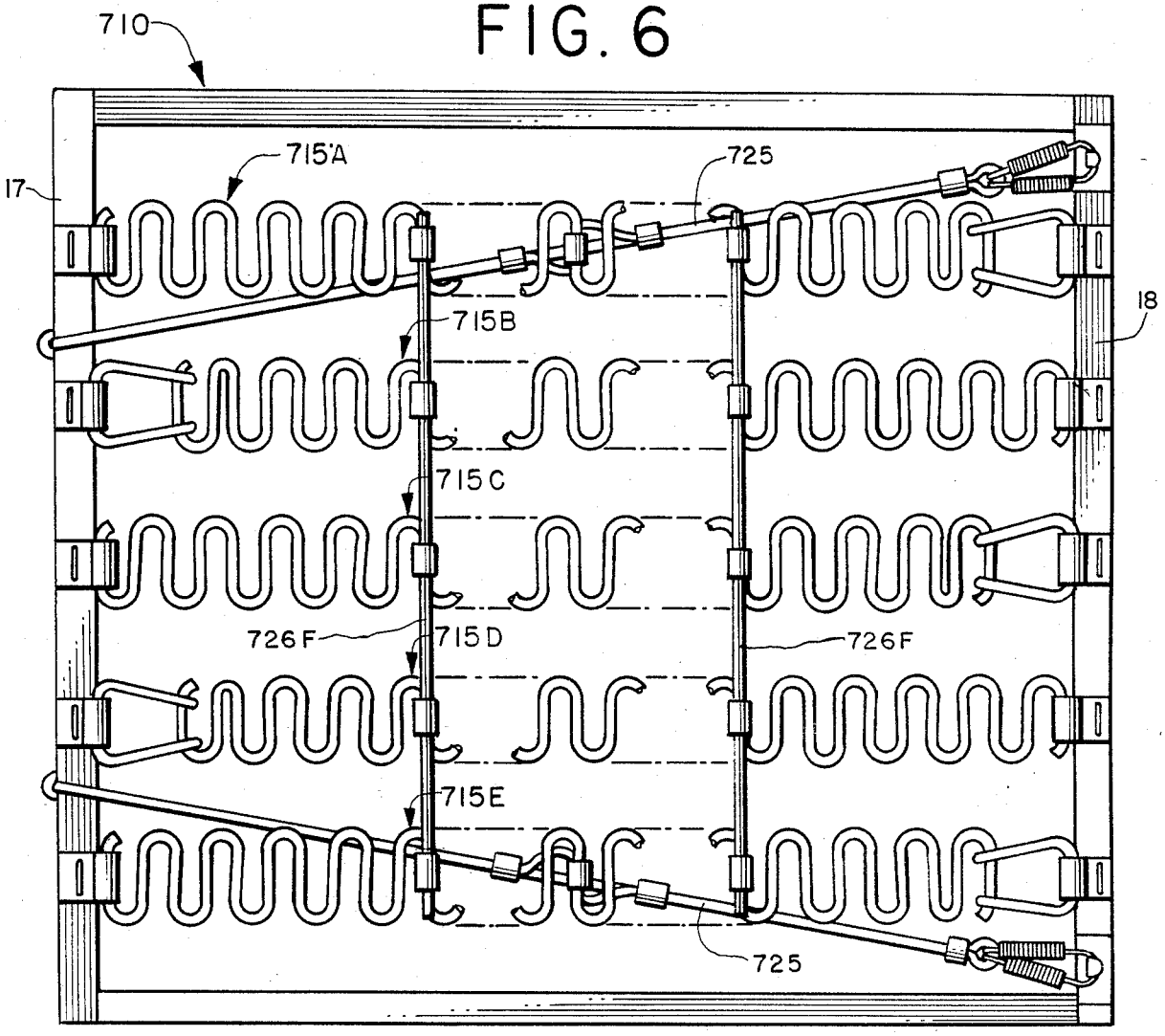
FIG. 6 is a view similar to FIG. 1 showing a seat base assembly embodying features of a fourth form of the present invention.

Referring now to FIG. 6, a fourth form of seat base assembly is seen generally at 710. The assembly 710 employs five (5) sinuous spring bands 715A, 715B, 715C, 715D, and 715E.

The two outermost bands 715A and 715E have self-contained torsioning components adjacent the back rail 18, as does the middle band 17C. They are constructed, arranged, and mounted in a manner identical to the bands 15A and 15F.

The remaining two intermediate bands 715B and 715D have self-contained torsioning component adjacent the front rail 17. In this sense they are identical in construction, arrangement, and mounting to the bands 15B and 15E.

The seat base assembly 710 employs span-key assemblies 725 and cross-ties 726B and 726F such as hereinbefore described. Their construction and arrangement corresponds identically to those described in relation to seat base assembly 10, for example.

Figure 7:
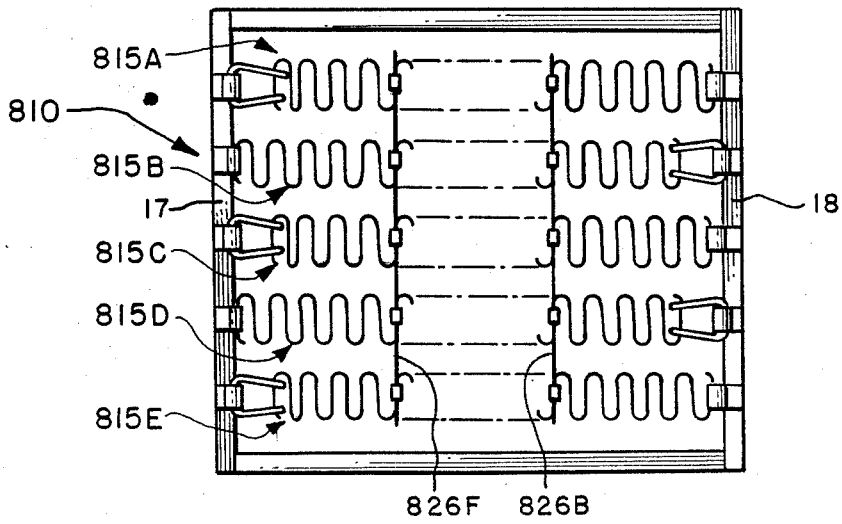
FIG. 7 is a view similar to FIG. 1 showing a seat base assembly embodying features of a fifth form of the present invention.

FIG. 7 illustrates a fifth form of seat base assembly embodying features of the invention at 810. The seat base assembly 810 employs five (5) sinuous spring bands 815A, 815B, 815C, 815D, and 815E; in this sense it is similar to seat spring assembly 710. The bands 815A et seq. are constructed identically to the bands 715A et seq. However, they are arranged and mounted in precisely reverse relationship to their corresponding bands in the sixth form of the seat spring assembly.

The seat base assembly 810, like the assembly 410, employs no key-span assembly. Similar results are obtained. Cross-ties 826F and 826B are employed.

It will be recognized that all forms of the seat base assembly embodying features of the invention which have been described to this point have identical sinuous band mounting structure. The bands are all mounted on the top of the front rail 17 and the back rail 18. Furthermore, those band ends which include self-contained torsioning components are pivotally connected to corresponding rails through articulated swing anchors while those band ends which do not are merely pivotally connected. The invention contemplates modifications in these mounting structures for all forms of the invention without departing from the inventive concept.

While several embodiments described herein are at present considered to be preferred, it is understood that various modifications and improvements may be made therein, and it is intended to cover in the appended claims all such modifications and improvements as fall within the true spirit and scope of the invention.

I claim:

1. A seat base assembly for an upholstered furniture seat base, comprising:

(a) a seat frame having front and back rails interconnected by generally parallel side rails;

(b) at least four normally arced sinuous spring bands connected between said front and back rails in generally parallel relationship with said side rails and with each other;

(c) each of said spring bands having torsioning structure adjacent only one of either said front rail or said back rail;

(d) at least two of said spring bands having torsioning structure adjacent only said front rail and at least two of said spring bands having torsioning structure adjacent only said back rail; and (e) two cross-tie means extending generally parallel to each other and to said front and back rails, and fastened to each of said spring bands at positions spaced substantially the same distance from each other and from said front and back rails.

2. The seat base assembly of claim 1 further characterized in that:

(a) the spring band closest to each of said side rails has torsioning structure adjacent said back rail.

3. The seat base assembly of claim 2 further characterized in that:

(a) at least two other bands have torsioning structure adjacent said front rail.

4. The seat base assembly of claim 1 further characterized in that:

(a) the spring band closest to each of said side rails has torsioning structure adjacent said front rail.

5. The seat base assembly of claim 1, 2, 3 or 4 further characterized in that:

(a) an even number of sinuous spring bands is connected between said front and back rails.

6. The seat base assembly of claims 1, 2, 3 or 4 further characterized in that:

(a) an odd number of sinuous spring bands is connected between said front and back rails.

7. The seat base assembly of claim 1 further characterized in that:

(a) the spring band closest to each of said side rails is supported approximately intermediate the front and back rails by a span extending between said front and back rails and a key between the span and corresponding band.

* * * * *

UNITED STATES PATENT AND TRADEMARK OFFICE

CERTIFICATE OF CORRECTION

PATENT NO. : 4,586,700

DATED : May 6, 1986

INVENTOR(S) : Lawton H. Crosby

It is certified that error appears in the above-identified patent and that said Letters Patent is hereby corrected as shown below:

In column 3, line 39, please delete the second occurrence of "torsioning".

In column 4, line 6, after "this", please insert --form,--.

Signed and Sealed this

Twelfth Day of December, 1989

*Attest:*

JEFFREY M. SAMUELS

*Attesting Officer*

*Acting Commissioner of Patents and Trademarks*